United States Patent [19]

Brame et al.

[11] Patent Number: 4,900,883

[45] Date of Patent: Feb. 13, 1990

[54] FLUID-OPERATED COMPOUND SWITCH

[75] Inventors: J. Yancey Brame, West Hartford; Michael F. Horn, Hamden; Jeffrey A. Saucier, Bristol; David L. Siedman, New Britain; Emery G. Thomas, West Hartford; Robert L. Varnum, Bristol, all of Conn.

[73] Assignee: Whitman Controls Corporation, Bristol, Conn.

[21] Appl. No.: 206,293

[22] Filed: Jun. 14, 1988

[51] Int. Cl.[4] ..... H01H 35/40

[52] U.S. Cl. ..... 200/83 S; 200/83 J; 73/861.47

[58] Field of Search ..... 307/118; 340/626; 92/5 R, 94, 101, 102; 73/861.47, 717, 723, 745; 200/82 R, 82 C, 308, 83 R, 83 J, 83 S, 83 SA

[56] References Cited

U.S. PATENT DOCUMENTS 3,372,372 3/1968 Carpenter ..... 200/83 S
4,438,305 3/1984 Johnson ..... 200/83 J

FOREIGN PATENT DOCUMENTS 1438238 4/1966 France ..... 200/83 J

*Primary Examiner*—Gerald P. Tolin

*Attorney, Agent, or Firm*—John H. Crozier

[57] ABSTRACT

In a preferred embodiment, a fluid-operated switch continuously and selectively adjustable over both a pressure range and a vacuum range. The switch includes a diaphragm enclosed in a housing, a first side of the diaphragm communicating with the fluid. On the second side of the diaphragm, actuator means are provided which actuate an electrical switch when the diaphragm is flexed by changes in the pressure or vacuum of the fluid. A main spring provides adjustable resistance to motion of the actuator means in the direction of diaphragm flexure corresponding to an increase in pressure, while a counterspring provides resistance to motion of the actuator means in the direction of diaphragm flexure corresponding to an increase in vacuum. Adjustment of the set point of the switch is effected through adjusting the degree of compression or relaxation of the springs by adjusting a threaded bonnet on the housing. At one degree of compression, the spring forces are balanced and further compression will selectively shift the set point into the pressure region, while relaxation of the springs from that balance point will selectively shift the set point into the vacuum region. Thus, one valve body with one set of internal elements can be field adjusted for either pressure or vacuum operation.

7 Claims, 4 Drawing Sheets

FLUID-OPERATED COMPOUND SWITCH

BACKGROUND OF THE INVENTION

1. Field of the Invention.

The present invention relates generally to fluid-operated switches generally and, more particularly, to such a switch that is adjustable to provide selective actuation over a range of either pressure or vacuum.

2. Background Art.

"Pressure", as used herein, will be understood to mean gage pressure, or pressure above atmospheric pressure, and "vacuum", as used herein, will be understood to mean s pressure less than atmospheric pressure, with "increasing vacuum" meaning pressure closer to zero absolute pressure.

Fluid-operated switches are well known devices which usually include a diaphragm one side of which communicates with a fluid under pressure or vacuum. The fluid may be any of a wide range of gases or liquids. On the other side of the diaphragm are means operatively connected between the diaphragm and switching means such as an electric switch. When the diaphragm is flexed by a change in the pressure or vacuum such that the change causes the fluid-operated switch to reach a set point, the electric switch is activated to make or break an electrical contact. Such fluid-operated switches are manufactured, for example, by Whitman Controls, of Bristol, Conn.

Although some conventional fluid-operated switches have fixed set points, many are constructed to be adjustable over a range of either pressure or vacuum and may be constructed to be field adjustable; that is, the user may selectively change the set points. In some cases, the housing of a given switch may be used in either pressure or vacuum applications, but the internal components are specific to one application or the other and must be changed, usually by the manufacturer, when it is desired to employ the switch in a different application from that for which it was originally constructed. Known conventional fluid-operated switches do not permit the user to employ them in either pressure or vacuum applications by convenient field adjustment.

Accordingly, it is a principal object of the present invention to provide a fluid-operated switch which may be field-adjusted to permit use in either pressure or vacuum applications without changing internal elements.

Another object of the invention is to provide such a switch which is easily and economically manufactured.

Other objects of the invention, as well as particular advantages and features thereof, will, in part, be obvious and will, in part, be apparent from the following description and the accompanying drawing figures.

SUMMARY OF THE INVENTION

The present invention accomplishes the above objects, among others, by providing, in a preferred embodiment, a fluid-operated switch including a diaphragm enclosed in a housing, a first side of the diaphragm communicating with the fluid. On the second side of the diaphragm, actuator means are provided which actuate an electrical switch when the diaphragm is flexed by changes in the pressure or vacuum of the fluid. A main spring provides adjustable resistance to motion of the actuator means in the direction of diaphragm flexure corresponding to an increase in positive pressure, while a counterspring provides resistance to motion of the actuator means in the direction of diaphragm flexure corresponding to an increase in vacuum. Adjustment of the set point of the switch is effected through adjusting the degree of compression or relaxation of the springs by adjusting a threaded bonnet on the housing. At one degree of compression, the spring forces are balanced and further compression will selectively shift the set point into the positive pressure region, while relaxation of the springs from that balance point will selectively shift the set point into the vacuum region. Thus, one valve body with one set of internal elements can be field adjusted for either pressure or vacuum operation.

DESCRIPTION OF THE PREFERRED EMBODIMENT

Figure 1:
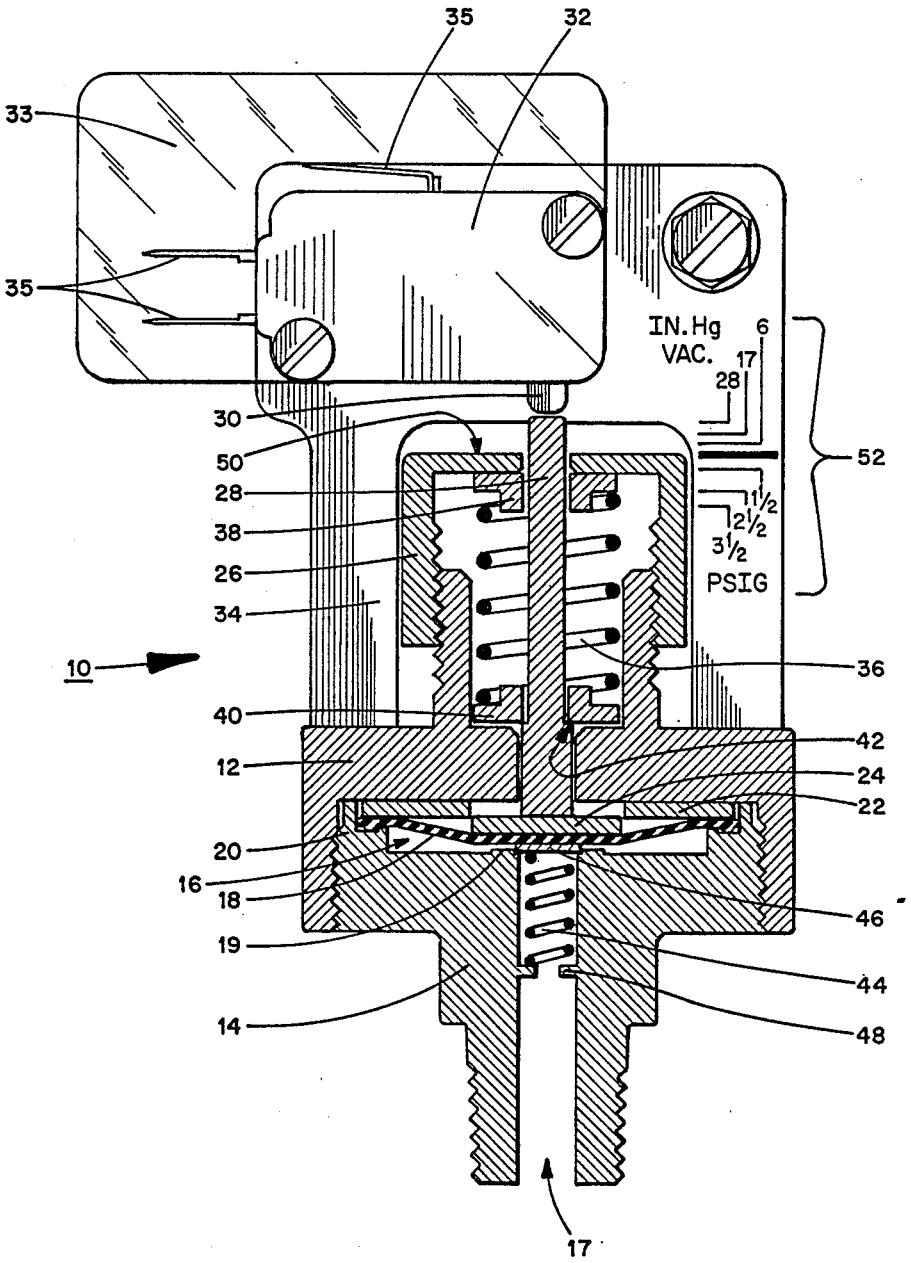
FIG. 1 is an enlarged front elevation view, partially in cross-section, of a fluid-operated compound switch constructed according to the present invention, with the switch in a neutral position.
Figure 2:
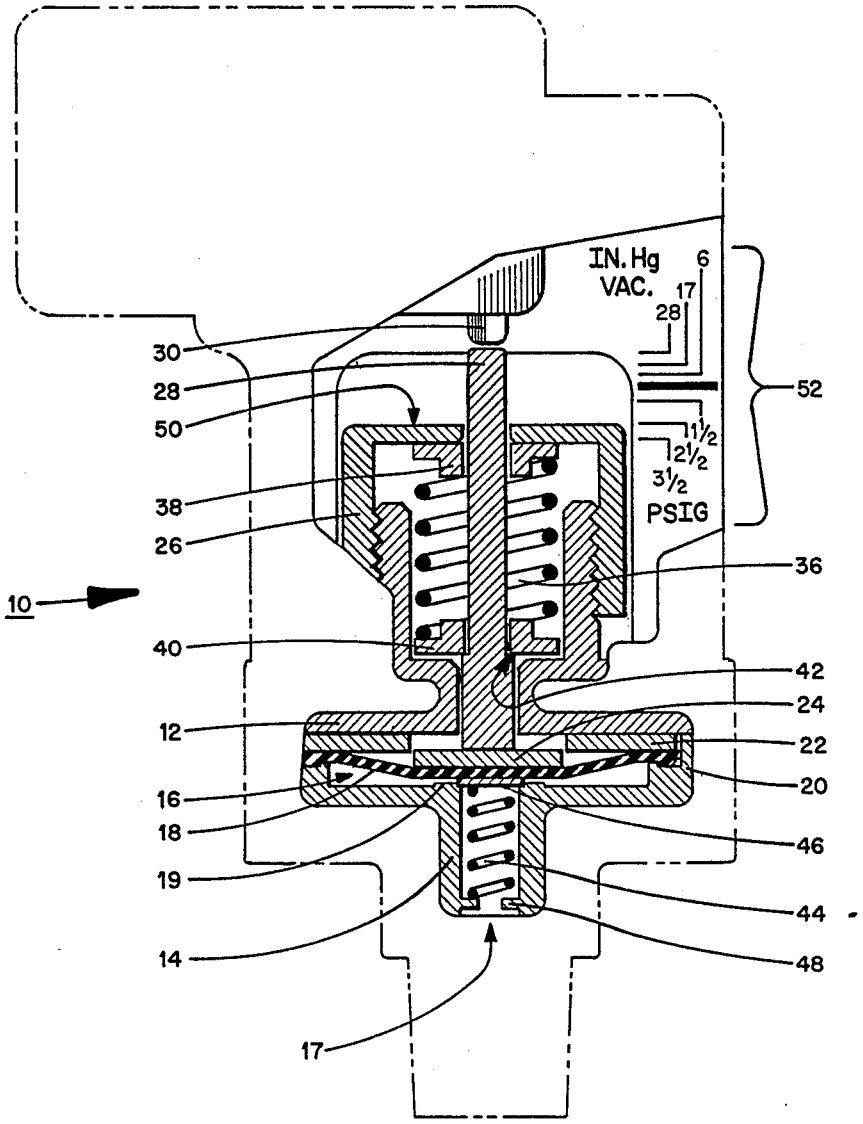
FIG. 2 is a fractional view of FIG. 1 with the switch in the pressure region.
Figure 3:
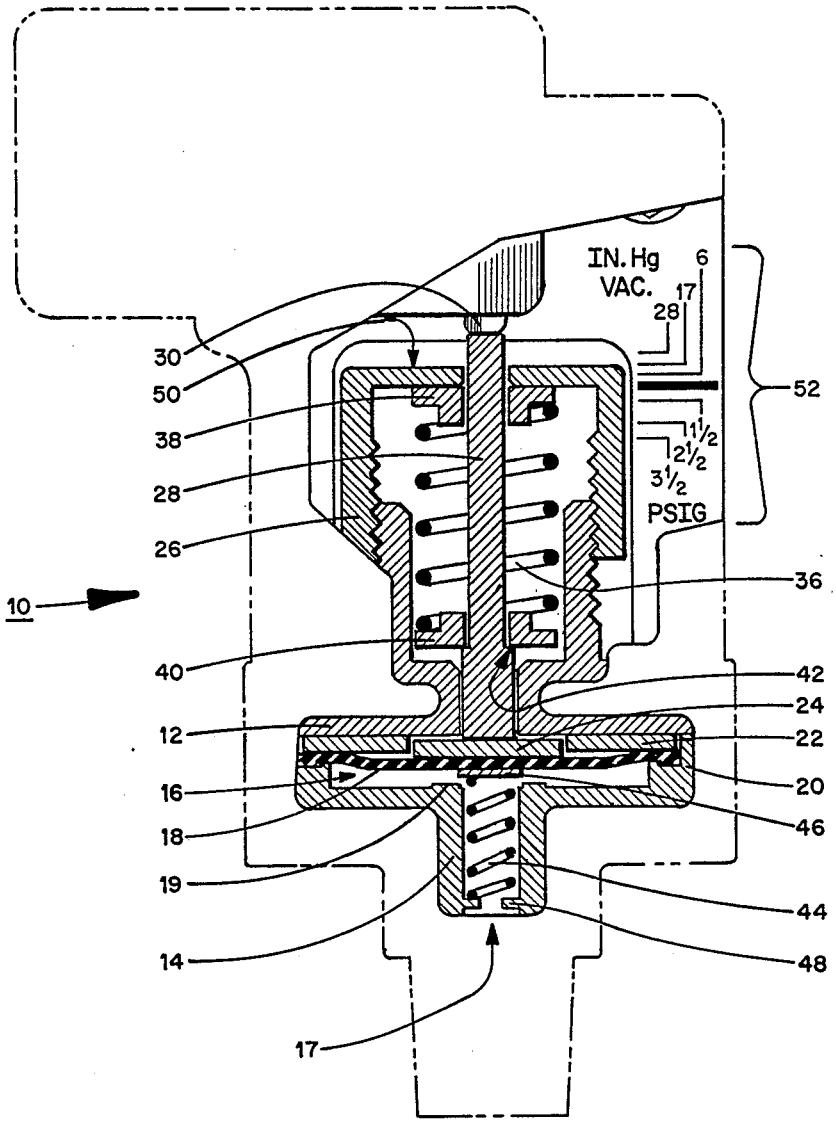
FIG. 3 is a fractional view of FIG. 1 with the switch in the vacuum region.
Figure 4:
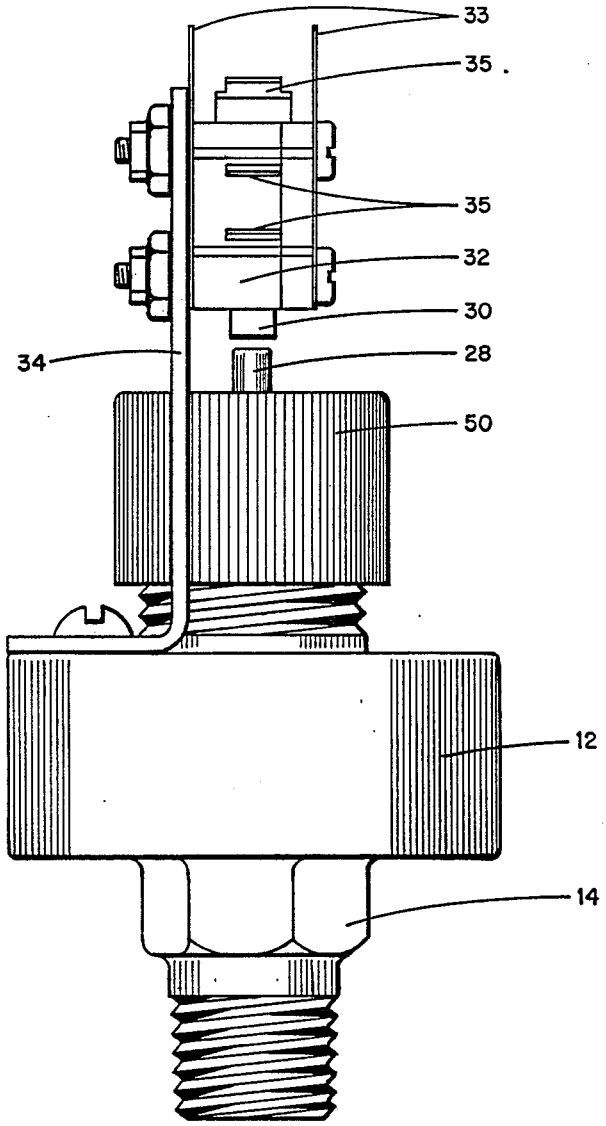
FIG. 4 is a side elevation of the switch of FIG. 1.

Referring now to the Drawing, FIGS. 1–3 are front elevation views, partially in cross-section, showing the compound switch of the present invention, generally indicated by the reference numeral 10, in neutral, pressure, and vacuum range positions, respectively, and FIG. 4 is a side elevation view of the switch. Switch 10 includes an upper body member 12 and a lower body member 14 attached together to define therebetween a chamber 16. A resilient diaphragm 18 is disposed within chamber 16 with the circumferential edge of the diaphragm fixedly grasped between stepped ledge 20 of lower body member 14 and an annular diaphragm backup disk 22, the latter being disposed adjacent upper body member 12. The lower part of chamber 16 is sealed from the atmosphere and communicates with the fluid (not shown) through channel 17 defined centrally of lower body member 14. The upper part of chamber 16 communicates with the atmosphere, so that fluid pressure will tend to cause diaphragm 18 to flex upward and fluid vacuum will tend to cause the diaphragm to flex downward. At least one and preferably three or more standoffs 19 are provided around the upper end of channel 17 on the upper surface of lower body member 14 to help release diaphragm 18 from that surface.

Loosely disposed centrally on the upper surface of diaphragm 18 is piston 24 which is held radially by annular disk 22, within which disk piston 24 is closely fitted for up-and-down motion relative thereto. Loosely disposed on piston 24 and supported centrally of switch 10 by close-fitting openings in upper body member 12 and an adjustment bonnet 26 is actuator rod 28 which follows the flexure motion of diaphragm 18. Actuator rod 28 is aligned with a switch button 30 of an electric switch 32 so that, at the upper extent of travel of the actuator rod, the rod will depress the switch button and cause the electric switch to either make or break a contact. Electric switch 32 is held in position relative to upper body member 12 by means of a bracket 34. Electric switch 32 may have dielectric shields 33 disposed as shown to protect against accidental contact with terminals 35.

The amount of force, proportional to the fluid pressure, that is required to effect movement of actuator rod to depress switch button 30 is determined, in part, by the degree of compression of a main spring 36 which is captured between upper and lower spring guide washers 38 and 40, respectively, which bear against the inside of the top of bonnet 26 and the top of a shoulder 42 on actuator rod 28, respectively. The greater the degree of compression of main spring 36, the higher will be the fluid pressure required to move actuator rod 28 to depress switch button 30. The compression of main spring 36 is increased by advancing adjustment bonnet 26 downward over the threaded extension of upper housing 12 and the compression of the main spring is decreased by moving the bonnet upward. The activation pressure, or set point, of switch 10 is approximately indicated by the position of top side 50 of adjustment bonnet 26 relative to a scale 52 disposed on the face of bracket 34. For the embodiments shown, the range of fluid pressure adjustability extends from 28 inches Hg vacuum to 3½ PSIG. The broad band in the middle of scale 52 indicates a dead zone between pressure and vacuum settings.

FIG. 2 shows switch 10 with a set point in the pressure region having been determined by adjustment bonnet 26 having been moved down from the position shown on FIG. 1, thereby compressing main spring 36. In this position, pressure applied to the lower side of diaphragm 18 through channel 17 will cause actuator rod 28 to depress switch button 30 when such pressure reaches the pressure set point. If the pressure subsequently falls below that set point, actuator rod 28 will pull away from switch button 30 and release it.

Urging actuator rod 28 toward switch button 30 in opposition to main spring 36 is counterspring 44 which is disposed in channel 17 between a reinforcing disk 46, bonded centrally to the lower side of diaphragm 18, and an annular flange 48 located in the channel. The presence of counterspring 44 requires that main spring 36 be compressed a little more than it otherwise would be for a particular pressure set point, but the primary function of the counterspring is when the set point is selected to be in the vacuum region. In that case, main spring 36 is relaxed to the point where counterspring 44 causes actuator rod to depress switch button 30, thus causing electric switch 32 to make or break a contact.

FIG. 3 shows switch 10 adjusted for a vacuum set point, where actuator rod 28 has depressed switch button 30. Vacuum applied to the lower side of diaphragm 18 will cause actuator rod 28 to move and release switch button 30, operating oppositely to the action of the switch when in a pressure set point range. When the vacuum lowers below the set point, actuator rod 28 will move upward to again depress switch button 30.

Thus, switch 10 can be adjusted to provide either a pressure or a vacuum set point without changing internal elements and such adjustment may be made in the field while the switch is installed and on-line. Other pressure and vacuum ranges different from those indicated on scale 52 may be provided by changing the size of piston 24 and/or the strength of main spring 36 and/or counterspring 44 while making no other changes to switch 10.

Upper and lower body members 12 and 14 and their internal components, except for diaphragm 18, are preferably constructed of metallic materials known in the art, although other materials known in the art and having suitable characteristics may be used as well. Diaphragm 18 is constructed of a resilient material suitable for use with the fluid contacted and for many applications is preferably a buna-N elastomeric material. Electric switch 32 may be of any type known in the art and may, for example, be a miniature snap-acting switch as manufactured by C&K/Unimax, of Wallingford, Connecticut. Dielectric shields 33 may be formed of Mylar "A" or Melinex 226.

It will thus be seen that the objects set forth above, among those made apparent from the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

We claim:

1. A fluid-operated compound switch, comprising:

(a) a body having therein defined an opening in communication with fluid means;

(b) switching means operatively connected to said body;

(c) actuator means within said body, responsive to the absolute pressure of said fluid, to actuate or deactuate said switching means, said actuator means having means for selectively adjusting an actuation set point of said switching means over both a positive pressure range and a vacuum range; and (d) said fluid means having a pressure range of from about 28 inches Hg vacuum to about 3½ PSIG.

2. A fluid-operated compound switch, as defined in claim 1, wherein said actuator means, comprises:

(a) a diaphram disposed within said body so that positive fluid pressure on a first side of said diaphragm will cause said diaphragm to flex in a first direction and fluid vacuum on said first side of said diaphragm will cause said diaphragm to flex in a second direction;

(b) first resistance means operatively connected to said diaphragm and having varying adjustable resistance to oppose flexure of said diaphragm in said first direction;

(c) second resistance means operatively connected to said diaphragm and having varying adjustable resistance to oppose flexure of said diaphragm in said second direction; and (d) means operatively connected to said diaphragm to transmit the motion of flexure of said diaphragm to said switching means.

3. A fluid-operated compound switch, as defined in claim 2, wherein;

(a) said first and second resistance means comprise springs; and (b) said varying adjustable resistance is effected by selectively varying the degree of compression or relaxation of said springs.

4. A fluid-operated compound switch, comprising:

(a) an upper body member;

(b) a lower body member attached to said upper body member;

(c) a chamber defined within said upper and lower body members;

(d) a diaphragm, having first and second sides, fixedly disposed in said chamber between said upper and lower body members;

(e) a channel defined within said lower body member to permit communication of said fluid with said first surface of said diaphragm so that positive fluid pressure will cause said diaphragm to flex in a first direction and fluid vacuum will cause said diaphragm to flex in a second direction;

(f) switching means fixedly disposed with respect to said upper body member;

(g) rod means to transmit said flexure of said diaphragm to said switch means;

(h) main spring means transmitting force to a shoulder formed on the periphery of said rod means so as to bias said diaphragm in said second direction, said main spring means (i) counterspring means operatively connected to bias said diaphragm in said first direction;

(j) adjusting means to selectively effect, together, compression and relaxation of said main spring and said counterspring.

5. A fluid-operated compound switch, as defined in claim 4, further comprising:

(a) an actuator rod operatively connected between said diaphragm said switching means;

(b) an adjustment bonnet threaded onto said upper housing;

(c) said main spring means is adjustably compressed between the inner surface of said adjustable bonnet and a shoulder on said actuator rod so as to bias said rod and said diaphragm in said second direction;

(d) said counterspring means is compressed between said diaphragm and said lower body member so as to bias said diaphragm in said first direction; and (e) advancing said adjustment bonnet onto said upper housing member compresses both said main spring means and said counterspring means.

6. A fluid-operated compound switch, as defined in claim 5, further comprising:

(a) piston means disposed between said actuator rod and said diaphragm; and (b) an annular backup disk disposed between said diaphragm and said upper body member, the central aperture of said disk accommodating said piston in closely-fitting relationship for axial movement therewith.

7. A fluid-operated compound switch, as defined in claim 5, wherein the relative position of said adjustment bonnet opposite a scale indicates the approximate set point of said fluid-operated switch.

* * * * *